US008616911B2

(12) United States Patent
Stark et al.

(10) Patent No.: US 8,616,911 B2
(45) Date of Patent: Dec. 31, 2013

(54) POWER LINE CONNECTOR APPARATUS INCLUDING A RIB AND RESILIENT RETAINING RING

(75) Inventors: Bobby A. Stark, Baltimore, MD (US); Charles A. Tustison, Lynnwood, WA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/329,759

(22) Filed: Dec. 19, 2011

(65) Prior Publication Data

US 2013/0157496 A1 Jun. 20, 2013

(51) Int. Cl.
*H01R 13/625* (2006.01)

(52) U.S. Cl.
USPC ..... 439/358

(58) Field of Classification Search
USPC ..... 439/352–358, 271–275
See application file for complete search history.

(56) References Cited

U.S. PATENT DOCUMENTS

| | | | | |
|---|---|---|---|---|
| 4,540,230 | A | 9/1985 | Iversen et al. | |
| 4,917,625 | A * | 4/1990 | Haile | 439/358 |
| 5,346,409 | A | 9/1994 | Weiner et al. | |
| 5,664,961 | A * | 9/1997 | Tsuji et al. | 439/358 |
| 6,287,136 | B1 | 9/2001 | Deutsch | |
| 6,688,923 | B2 * | 2/2004 | Lee et al. | 439/848 |
| 6,848,930 | B2 | 2/2005 | Fukuda | |
| 7,357,660 | B2 | 4/2008 | Togawa | |
| 7,470,076 | B1 | 12/2008 | Dickover et al. | |
| 7,503,776 | B1 | 3/2009 | Pavlovic et al. | |
| 7,520,772 | B2 * | 4/2009 | Hanks | 439/427 |
| 2003/0100223 | A1 | 5/2003 | Lee et al. | |
| 2007/0117447 | A1 | 5/2007 | Hanks | |

FOREIGN PATENT DOCUMENTS

| | | |
|---|---|---|
| DE | 3924045 A1 | 1/1991 |
| EP | 0175036 A1 | 3/1986 |
| NL | 8400497 A | 9/1985 |

OTHER PUBLICATIONS

"K3605 Product Family", www.harwin.com [online] 2004, [accessed online Oct. 24, 2011], URL: http://www.harwin.com/K3605-power-connector-oring-family.html.

"Coaxial Power Connector", www.wikipedia.org [online] 2011, [accessed online Oct. 24, 2011], URL: http://en.wikipedia.org/wiki/Coaxial_power_connector.

* cited by examiner

*Primary Examiner* — Chandrika Prasad
(74) *Attorney, Agent, or Firm* — H. Barrett Spraggins; Katherine S. Brown; Biggers Kennedy Lenart Spraggins LLP

(57) ABSTRACT

A power line connector apparatus and a method of coupling a first power line connector to a second power line connector are provided. Embodiments include a first power line connector comprising an outer casing that includes a groove that forms a recessed space annularly around the outer casing, the groove opening radially outward from the outer casing; a second power line connector comprising an electrical contact housing including a rib that forms a recessed space annularly along the inner walls of the electrical contact housing; and a resilient retaining ring located at least partially within the recessed space of the groove, the ring compressing against the inner walls of the electrical contact housing as the first connector is inserted into the electrical contact housing of the second connector, the ring uncompressing within the recessed space of the rib as the first connector is fully inserted into the housing.

6 Claims, 3 Drawing Sheets

POWER LINE CONNECTOR APPARATUS INCLUDING A RIB AND RESILIENT RETAINING RING

BACKGROUND OF THE INVENTION

1. Field of the Invention

The field of the invention is data processing, or, more specifically, power line connector apparatuses and methods of coupling a first power line connector to a second power line connector.

2. Description of Related Art

A typical data center may utilize a large number of electrical power lines to power devices. Due to operation of the devices, cooling of the devices, or tangling of the power lines, a power line may be subjected to forces, such as vibration, temperature based expansion and contraction, and manipulation of individual power lines or bundles of power lines. These forces may make it difficult to maintain coupling between power line connectors.

SUMMARY OF THE INVENTION

An electrical connector apparatus and a method of coupling a first power line connector to a second power line connector are provided. Embodiments include a first power line connector comprising an outer casing that includes a groove that forms a recessed space annularly around the outer casing, the groove opening radially outward from the outer casing; a second power line connector comprising an electrical contact housing, the electrical contact housing including an electrical interface to establish an electrical connection with the first power line connector, the electrical contact housing including a rib that forms a recessed space annularly along the inner walls of the electrical contact housing; and a resilient retaining ring located at least partially within the recessed space of the groove, the retaining ring compressing against the inner walls of the electrical contact housing as the first power line connector is inserted into the electrical contact housing of the second power line connector, the retaining ring uncompressing within the recessed space of the rib as the first power line connector is fully inserted into the electrical contact housing.

The foregoing and other objects, features and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION OF EXEMPLARY EMBODIMENTS

Figure 1:
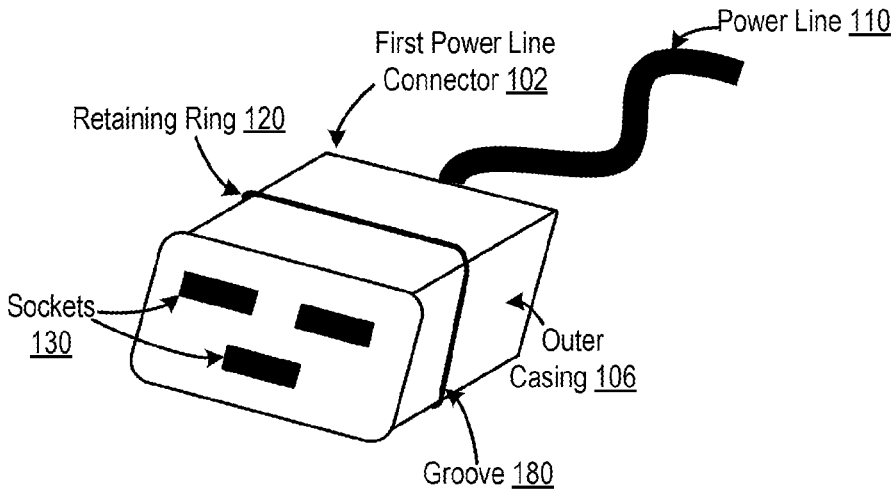
FIG. 1 sets forth a diagram of an example power line connector according to embodiments of the present invention.

Exemplary power line connector apparatuses and methods of coupling a first power line connector to a second power line connector in accordance with the present invention are described with reference to the accompanying drawings, beginning with FIG. 1. FIG. 1 sets forth a diagram of an example power line connector (102) according to embodiments of the present invention. A power line connector is a type of electrical component that includes an electrical contact interface to couple a power line to another electrical contact interface. Examples of power line connectors include a C13 connector or a C14 connector, as specified by the IEC 60320 set of international standards.

In the example of FIG. 1, the first power line connector (102) is a female power line connector with an electrical contact interface that includes sockets (130) for establish of an electrical connection with pins of a corresponding male power line connector. When the pins of a male power line connector are inserted into the sockets (130) of the first power line connector (102), power may be delivered to the male power line connector via the power line (110) of the first power line connector (102).

The first power line connector (102) includes an outer casing (106) that at least partially surrounds the electrical connection interface of the first power line connector (102). The outer casing (106) may be any type of material that protects the electrical connection interface, such as plastic. In the example of FIG. 1, the outer casing (106) includes a groove (180) that forms a recessed space annularly around the outer casing (108). The groove (180) opens radially outward from the outer casing (108). In the example of FIG. 1, a resilient retaining ring (120) is located at least partially within the recessed space of the groove (180). A retaining ring is a type of mechanical gasket. Examples of retaining rings include an o-ring, also known as a packing, or a toric joint. O-rings are mechanical gaskets in the shape of a torus and generally comprising a loop of elastometer with a disc-shaped cross-section designed to be seated in a groove.

Figure 2:
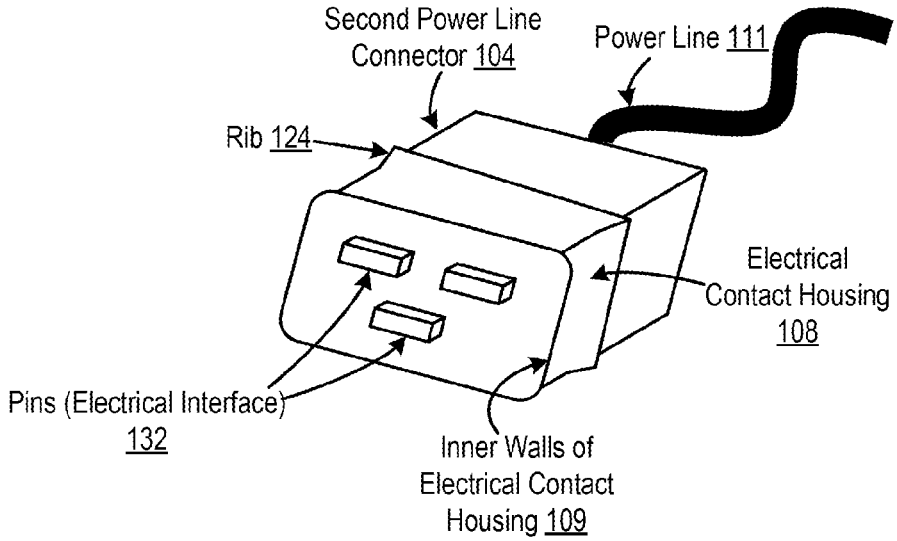
FIG. 2 sets forth a diagram of another example power line connector according to embodiments of the present invention.

As explained above, the first power line connector (102) is designed to couple with a male power line connector. FIG. 2 sets forth a diagram of a second power line connector (104) according to embodiments of the present invention. The second power line connector (104) is a male power line connector that includes pins (electrical interface) (132) to insert into the sockets (130) of the first power line connector (102) for delivery of electrical power to a power line (111) of the second power line connector (104).

In the example of FIG. 2, the second power line connector (104) includes an electrical contact housing (108). The electrical contact housing (108) forms an area that at least partially surrounds the electrical interface (132) of the second power line connector (104). The electrical contact housing (108) also includes a rib (124) that forms a recessed space annularly along the inner walls (109) of the electrical contact housing (108).

When the first power line connector (102) is inserted into the electrical contact housing (108), the retaining ring (120) contacts the inner walls (109) of the electrical contact housing (108). The position of the retaining ring (120) in the first power line connector (102) is maintained by the groove (180)

but the retaining ring (120) moves against the inner walls (109) of the electrical contact housing (108). For the first power line connector (102) to insert into the second power line connector (104), the retaining ring (120) compresses and provides friction between the first power line connector (102) and the second power line connector (104). The retaining ring (120) remains compressed until aligning with the rib (124) along the inner walls (109) of the second power line connector (104), at which time the retaining ring (120) may expand into the recessed space of the rib (124). That is, the rib (124) acts to stabilize the position of the retaining ring (120) and thus helps maintain the connection between the first power line connector (102) and the second power line connector (104).

Figure 3:
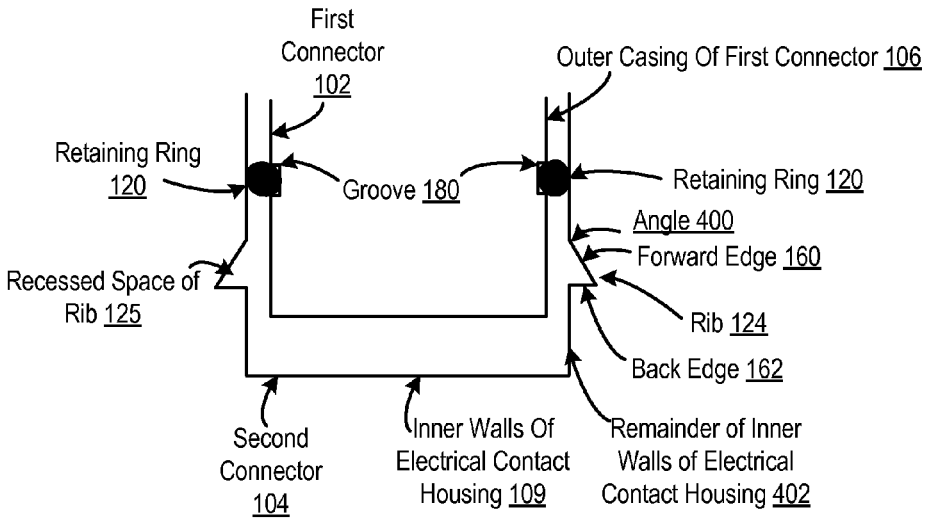
FIG. 3 sets forth a diagram of an example power line connector apparatus according to embodiments of the present invention.
Figure 4:
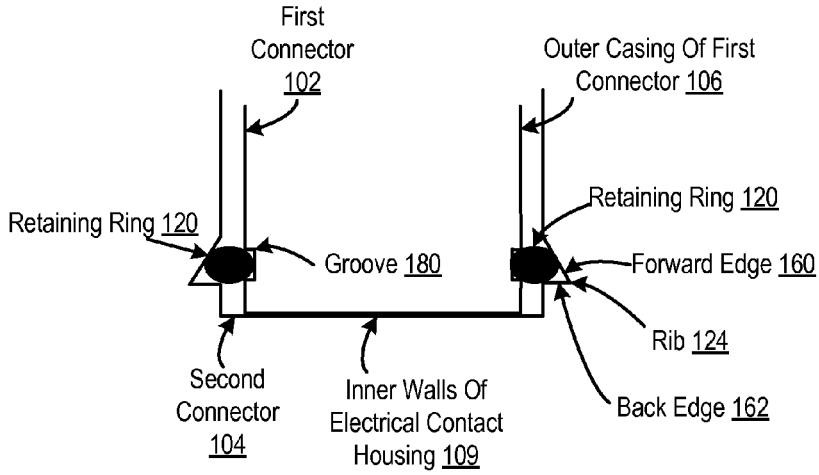
FIG. 4 sets forth a diagram of another example power line connector apparatus according to embodiments of the present invention.

FIGS. 3 and 4 further illustrate the function of the retaining ring (120), the groove (180), and the rib (124) in coupling the first power line connector (102) to the second power line connector (104) according to embodiments of the present invention. FIG. 3 sets forth a diagram of an example power line connector apparatus according to embodiments of the present invention.

In the example of FIG. 3, the first power line connector (102) is partially inserted into the electrical contact housing (108) of the second power line connector (104). In this position, an electrical connection between the two connectors may not be established. That is, the pins (132) of the second power line connector (104) are not inserted into the sockets (130) of the first power line connector (102).

As explained above, the retaining ring (120) compresses against the inner walls (109) of the electrical contact housing (108) as the first power line connector (102) is inserted into the electrical contact housing (108) of the second power line connector (104). The retaining ring (120) may remain compressed between the groove (180) and the inner walls of the electrical contact housing (109) until the retaining ring (120) is aligned with the rib (124).

In the example of FIG. 3, the contour of the rib (124) includes a forward edge (160) and a back edge (162). The forward edge (160) extends within the electrical contact housing (108) at an angle and the back edge (162) forms an abutment between the forward edge (160) and the remainder (402) of the inner walls (109) of the electrical contact housing (108). The angle of the forward edge (160) helps the retaining ring compress into a recessed space (125) of the rib (124). In the example of FIG. 3, the angle that the forward edge (160) extends within the electrical contact housing (108) is in the opposite direction of removal of the first power line connector (102) from the electrical contact housing (108) of the second power line connector (104) and the direction that the back edge (162) extends within the electrical contact housing (108) is substantially parallel to the radius of the electrical contact housing (108).

FIG. 4 sets forth a diagram of another example power line connector apparatus according to embodiments of the present invention. In the example of FIG. 4, the first connector (102) is in a fully inserted position within the second connector (104). In the fully inserted position, the pins (132) of the second power line connector (104) are inserted into the sockets (130) of the first power line connector (102).

As explained above, when the first connector (102) is in the fully inserted position, the retaining ring (120) uncompresses within the recessed space (125) of the rib (124).

Contact between the back edge (162) of the rib (124) and the resilient retaining ring (120) prevents the first power line connector (102) from being inserted within the electrical contact housing (108) beyond the fully inserted position. That is, the rib (124) acts to stabilize the position of the retaining ring (120) and thus help maintain the connection between the first power line connector (102) and the second power line connector (104). Likewise, as the first power line connector (102) is moved from the fully inserted position, the retaining ring (120) recompresses until the first connector (102) is fully removed from the second connector (104).

Figure 5:
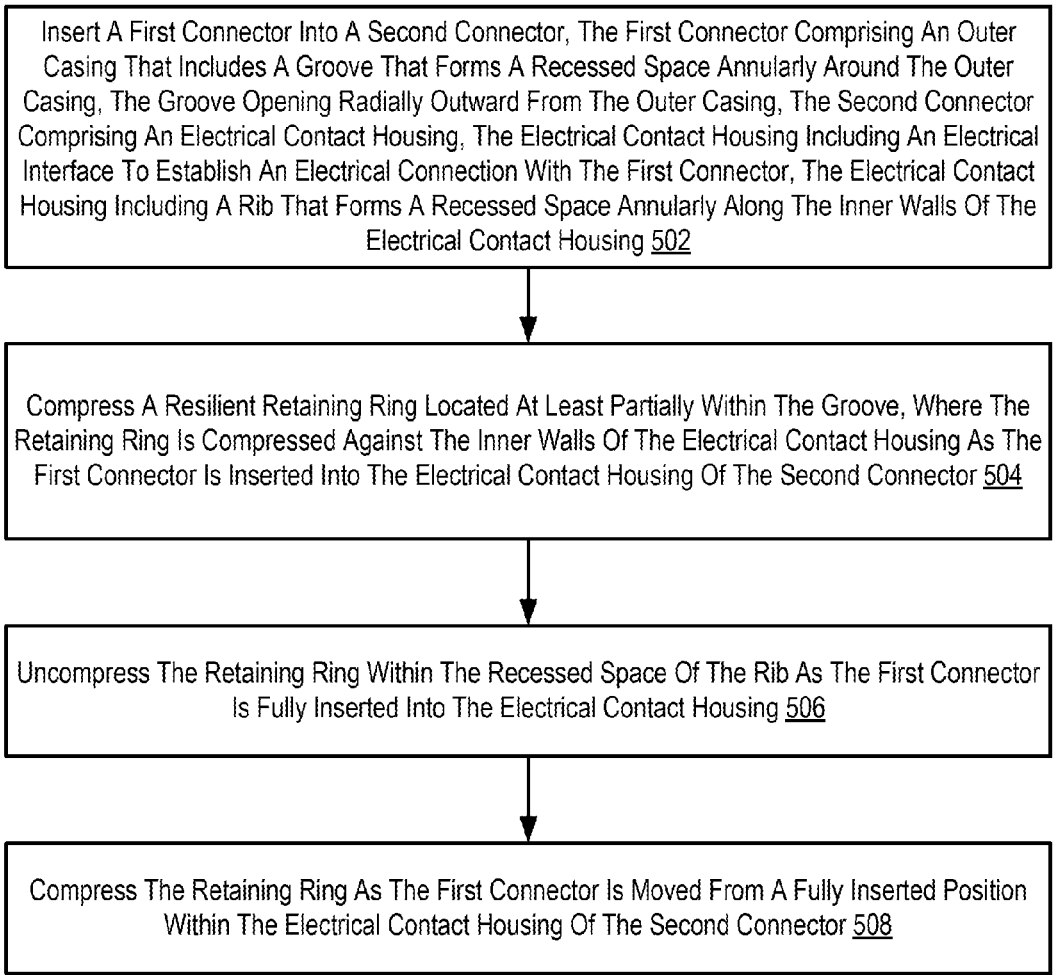
FIG. 5 sets forth a flow chart illustrating an exemplary method of coupling a first power line connector to a second power line connector according to embodiments of the present invention.

For further explanation, FIG. 5 sets forth a flow chart illustrating an exemplary method for coupling a first power line connector to a second power line connector according to embodiments of the present invention. For ease of explanation, the method of FIG. 5 references the example power line connector apparatuses of FIGS. 1-4.

The method of FIG. 5 includes inserting (502) a first power line connector (102) into a second power line connector (104). In the example of FIG. 5, the first power line connector (102) comprising an outer casing (106) that includes a groove (180) that forms a recessed space annularly around the outer casing (106) and the groove (180) opens radially outward from the outer casing (106). In the example of FIG. 5, the second power line connector (104) comprises an electrical contact housing (108) that includes an electrical interface (132) to establish an electrical connection with the first power line connector (102). The electrical contact housing (108) of FIG. 5 includes a rib (124) that forms a recessed space (125) annularly along the inner walls (109) of the electrical contact housing (108).

The method of FIG. 5 also includes compressing (504) a resilient retaining ring (120) located at least partially within the groove (180). In the example of FIG. 5, the retaining ring (180) is compressed against the inner walls (109) of the electrical contact housing (108) as the first power line connector (102) is inserted into the electrical contact housing (108) of the second power line connector (104). Compressing (504) a resilient retaining ring (120) located at least partially within the groove (180) may be carried out by changing the shape of the retaining ring (180) such that the retaining ring (120) increases force and pressure between the inner walls (109) of the electrical contact housing (108) of the second connector (104) and the first connector (102).

The method of FIG. 5 also includes uncompressing (506) the retaining ring (180) within the recessed space (125) of the rib (124) as the first power line connector (102) is fully inserted into the electrical contact housing (109). Uncompressing (506) the retaining ring (120) may be carried out by the retaining ring (180) expanding into the recessed space (125).

The method of FIG. 5 includes compressing (508) the retaining ring (180) as the first power line connector (102) is moved from a fully inserted position within the electrical contact housing (109) of the second power line connector (104). Compressing (508) the retaining ring (180) may be carried out by changing the shape of the retaining ring (180) such that the retaining ring (120) increases force and pressure between the inner walls (109) of the electrical contact housing (108) of the second connector (104) and the first connector (102).

Aspects of the present invention are described above with reference to flowchart illustrations and/or block diagrams of apparatuses and methods according to embodiments of the invention. The flowchart and block diagrams in the Figures illustrate the architecture, functionality, and operation of possible implementations of the power line connector apparatuses and methods according to various embodiments of the present invention. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will be understood from the foregoing description that modifications and changes may be made in various embodiments of the present invention without departing from its true spirit. The descriptions in this specification are for purposes of illustration only and are not to be construed in a limiting sense. The scope of the present invention is limited only by the language of the following claims.

What is claimed is:

1. A power line connector apparatus, the power line connector apparatus comprising:

a first power line connector comprising an outer casing that includes a groove that forms a recessed space annularly around the outer casing, the groove opening radially outward from the outer casing;

a second power line connector comprising an electrical contact housing, the electrical contact housing including an electrical interface to establish an electrical connection with the first power line connector, the electrical contact housing including a rib that forms a recessed space annularly along one or more inner walls of the electrical contact housing; and a resilient retaining ring located at least partially within the recessed space of the groove, the retaining ring compressing against the inner walls of the electrical contact housing as the first power line connector is inserted into the electrical contact housing of the second power line connector, the retaining ring uncompressing within the recessed space of the rib as the first power line connector is fully inserted into the electrical contact housing;

wherein the contour of the rib comprises a forward edge and a back edge, the forward edge extending within the electrical contact housing at an angle with respect to a portion of the inner walls of the electrical contact housing, the back edge forming an abutment between the forward edge and the remainder of the inner walls of the electrical contact housing; and wherein the direction that the back edge extends within the electrical contact housing is substantially parallel to a radius of the electrical contact housing such that contact between the back edge of the rib and the resilient retaining ring prevents the first power line connector from being inserted within the electrical contact housing beyond a fully inserted position.

2. The power line connector apparatus of claim 1 wherein the angle that the forward edge extends within the electrical contact housing is in the opposite direction of removal of the first power line connector from the electrical contact housing of the second power line connector.

3. The power line connector apparatus of claim 1 wherein the retaining ring compresses as the first power line connector is moved from a fully inserted position within the electrical contact housing of the second power line connector to a partially inserted position within the electrical contact housing of the second power line connector.

4. A method of coupling a first power line connector to a second power line connector, the method comprising:

inserting a first power line connector into a second power line connector, the first power line connector comprising an outer casing that includes a groove that forms a recessed space annularly around the outer casing, the groove opening radially outward from the outer casing, the second power line connector comprising an electrical contact housing, the electrical contact housing including an electrical interface to establish an electrical connection with the first power line connector, the electrical contact housing including a rib that forms a recessed space annularly along one or more inner walls of the electrical contact housing;

compressing a resilient retaining ring located at least partially within the groove, wherein the retaining ring is compressed against the inner walls of the electrical contact housing as the first power line connector is inserted into the electrical contact housing of the second power line connector; and uncompressing the retaining ring within the recessed space of the rib as the first power line connector is fully inserted into the electrical contact housing;

wherein the contour of the rib comprises a forward edge and a back edge, the forward edge extending within the electrical contact housing at an angle with respect to a portion of the inner walls of the electrical contact housing, the back edge forming an abutment between the forward edge and the remainder of the inner walls of the electrical contact housing; and wherein the direction that the back edge extends within the electrical contact housing is substantially parallel to a radius of the electrical contact housing such that contact between the back edge of the rib and the resilient retaining ring prevents the first power line connector from being inserted within the electrical contact housing beyond a fully inserted position.

5. The method of claim 4 further comprising compressing the retaining ring as the first power line connector is moved from a fully inserted position within the electrical contact housing of the second power line connector to a partially inserted position within the electrical contact housing of the second power line connector.

6. The method of claim 5 wherein the angle that the forward edge extends within the electrical contact housing is in the opposite direction of removal of the first power line connector from the electrical contact housing of the second power line connector.

* * * * *